US005221221A

United States Patent [19]

Okaniwa

[11] Patent Number: 5,221,221

[45] Date of Patent: Jun. 22, 1993

[54] FABRICATION PROCESS FOR MICROMINIATURE ELECTRON EMITTING DEVICE

[75] Inventor: Kazuhiro Okaniwa, Itami, Japan

[73] Assignee: Mitsubishi Denki Kabushiki Kaisha, Tokyo, Japan

[21] Appl. No.: 644,996

[22] Filed: Jan. 22, 1991

[30] Foreign Application Priority Data

Jan. 25, 1990 [JP] Japan ..... 2-17493

[51] Int. Cl.[5] ..... H01J 1/30; H01J 9/02

[52] U.S. Cl. ..... 445/24; 156/650; 156/657

[58] Field of Search ..... 445/24; 437/974, 79, 437/59, 225; 148/DIG. 135, DIG. 168; 156/650, 657, 649, 648

[56] References Cited

U.S. PATENT DOCUMENTS

| | | | |
|---|---|---|---|
| 3,665,241 | 5/1972 | Spindt et al. | 313/351 |
| 4,199,860 | 4/1980 | Beelitz et al. | 437/974 |
| 4,307,507 | 12/1981 | Gray et al. | 29/580 |
| 4,578,614 | 3/1986 | Gray et al. | 313/309 |
| 4,671,851 | 6/1987 | Beyer et al. | 156/662 X |
| 4,685,996 | 8/1987 | Busta et al. | 156/657 |
| 4,859,629 | 8/1989 | Reardon et al. | 437/974 |
| 5,057,047 | 10/1991 | Greene et al. | 445/24 |

FOREIGN PATENT DOCUMENTS

| | | | |
|---|---|---|---|
| 160740 | 12/1981 | Japan | 445/50 |
| 8909479 | 10/1989 | World Int. Prop. O. | 313/336 |

OTHER PUBLICATIONS

"A Vacuum Field Effect Transistor Using Silicon Field Emitter Arrays," Gray et al., IEDM 86, pp. 776–779.

Patent Abstract of Japan, vol. 6, No. 47 (E-99) (924), Mar. 26, 1982 "Manufacture Of Thin-Film Field Type Cold Cathode".

Extended Abstracts, vol. 86-1, No. 1, May 1986, pp. 403–404 "Micromachined Tungsten Field Emitters".

*Primary Examiner*—Kenneth J. Ramsey

*Attorney, Agent, or Firm*—Leydig, Voit & Mayer

[57] ABSTRACT

A process for fabricating an electron emitting vacuum type device having a tipped electron emitter supported on a substrate and disposed in a vacuum for emitting electrons. The process utilizes a substrate having opposed substantially planar front and rear surfaces. The front surface, carrying a series of conical depressions, is plated with a metallic layer of electron emitting material which lines the apertures to form metallic structures having tips buried in the substrate. A first material removal process, comprising grinding, is performed on the rear of the substrate to remove the bulk of the substrate but leaving the tips protected within the substrate. A second operation comprising a finishing operation is then applied to the rear surface to advance the plane of the rear surface from an as-ground to an as-finished position. The finishing operation employs a wet etching solution, and may employ mechanical friction (free of abrasive particles) to assist the speed of etching and uniformity of the finished surface. The as-finished plane of the surface serves to expose the metallic tips so that they can serve as emitters in a vacuum tube device.

18 Claims, 5 Drawing Sheets

FIG. 2. (PRIOR ART)
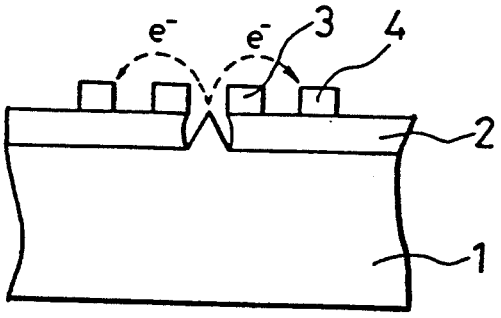
FIG. 3. (a) (PRIOR ART)
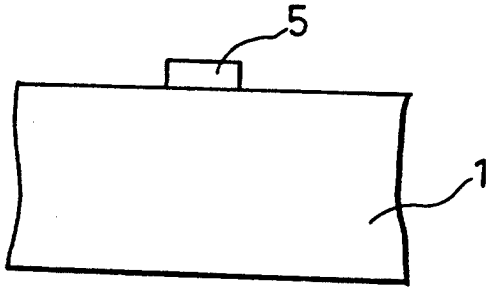
FIG. 3. (b) (PRIOR ART)
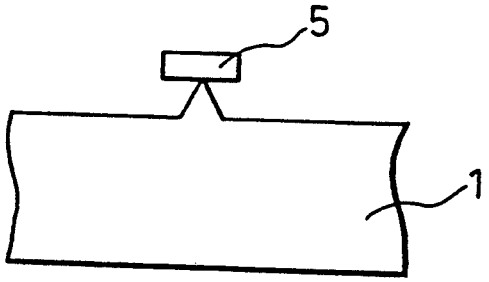
FIG. 3. (c) (PRIOR ART)
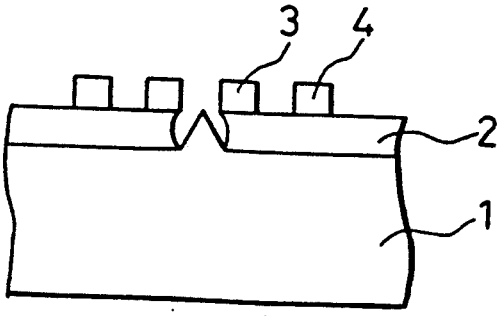

FIG. 5.
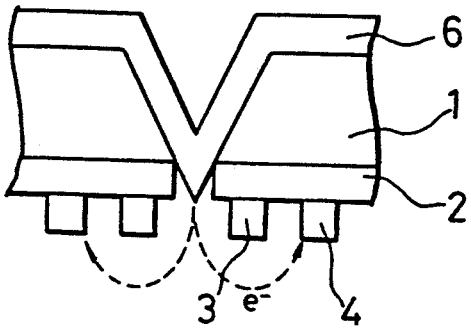
FIG. 6.(a)
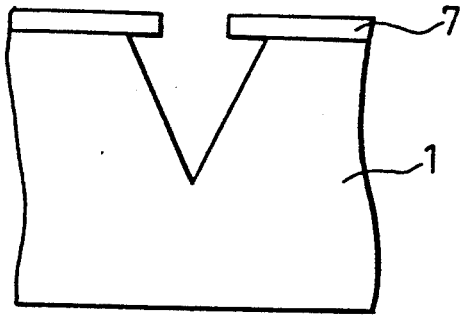
FIG. 6.(b)
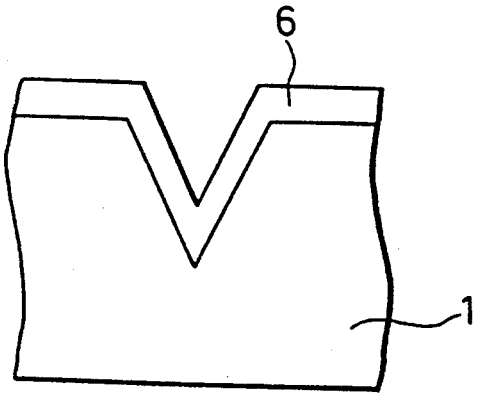
FIG. 6.(c)
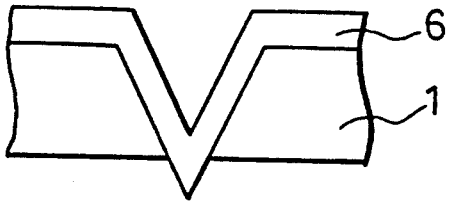
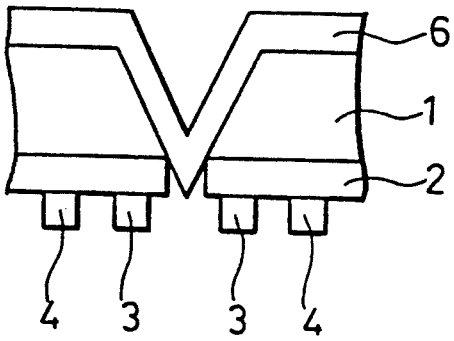
FIG. 6.(d)

FABRICATION PROCESS FOR MICROMINIATURE ELECTRON EMITTING DEVICE

FIELD OF THE INVENTION

This invention relates to microminiature electron emitting vacuum devices, and more particularly to a process for fabricating the devices which assures the uniformity of the tip shaped electron emitters.

BACKGROUND OF THE INVENTION

Microminiature vacuum tubes are being investigated for their potential of higher speed operation over solid state devices, occasioned by the fact that carriers in the tube-type devices travel in vacuum rather than through solid state semiconducting material. If the devices can be made sufficiently small to "miniaturize" the travel distances between the electron emitter (sometimes called the cathode) and the collector (sometimes called the anode), very high speed of operation is potentially available. That makes such devices very attractive for application such as very high speed switching devices at ultra-high frequencies.

Since such devices use no cathode heaters, potentials must be utilized which are adequate to cause the cold emission of electrons from the cathode for collection by the anode. The magnitude of the field voltages can be reduced if the anode and cathode are rather closely spaced, and if the cathode (or emitter) is shaped to provide a point or sharp edge which causes a concentration in field intensity at the point or line, enhancing the ability to emit electrons with a lower potential. One of the problems which has been encountered in such devices, however, is the reliable formation of emitter structures with the necessary sharply pointed characteristic. When such devices are formed in an array with multiple devices (multiple vacuum tubes) on the same substrate for interconnection and therefore integration, problems of reliability of the overall device can become even more acute when the processes do not assure that all of the emitters are properly formed, and therefore have the same characteristics.

As an example, FIG. 2 shows a form of microminiature vacuum tube disclosed in the proceedings of the International Electron Device Meeting of 1986 (IEDM '86) at page 776 and entitled "A Vacuum Field Effect Transistor Using Silicon Field Emitter Arrays". FIG. 2 shows a microminiature vacuum tube generally indicated at 10 based on a semiconductor substrate 1 such as n-type silicon. The upper surface of the substrate 1 is treated as by etching to produce a conical emitter 6. A layer 2 of insulating film such as silicon dioxide surrounds the emitter 6. Located on the film is a grid structure 3 and collector electrodes 4. Electrons emitted from the tip of the conical emitter 6 due to the electric field existing as a result of a potential applied from emitter to collector travel the arcuate path suggested by $e^-$ to be collected at the collector. A voltage applied to the grid 3 affects the field existing between the point of the emitter and the collector, and thus controls electron flow. The device can be used in a linear mode, or as a switch; in both cases, voltages applied to the grid control electron flow between emitter and collector.

It is important to note that the tip of the conical emitter 6 is shaped as it is to enhance the electrostatic field at the tip and thereby facilitate emission of electrons. If the tip were flatter, substantially higher potentials would be required to achieve the same magnitude of electron flow If the conical emitter 6 were shaped to be substantially shorter, higher potentials would also be required because of the increased distance between emitter and collector. Thus, the importance of the shape and disposition of the emitter are understood to be an important factor in achieving reliable and repeatable operation of vacuum tube devices such as illustrated in FIG. 2.

The process for forming the device of FIG. 2 is illustrated in FIGS. 3*a*–3*c*. As seen in FIG. 3*a*, the n-type silicon substrate 1 is patterned to produce a photoresist mask 5 defining the central area of the substrate in which the conical emitter is to be formed. A wet etching process is then carried out using an etching solution, such as a KOH aqueous solution. The substrate 1 underlying the photoresist 5 is underetched due to the isotropic nature of the wet etching process. As a result, when etching is completed, a sharp-edged configuration of conical shape is obtained, as illustrated in FIG. 3*b*.

When the process has proceeded to the stage illustrated in FIG. 3*b*, the photoresist 5 is removed and the cathode portion 6 is covered with a film of SiN, then annealed. Following that an $SiO_2$ film 2 is formed over the remainder of the upper surface of the substrate 1 as shown in FIG. 3*c*. The SiN which had protected the emitter during the deposition of the $SiO_2$ is then removed, and a grid structure 3 and collector structure 4 are deposited on the upper surface of the insulating film as indicated in FIG. 3*c*. Such electrode structures are deposited using conventional plating and lift-off techniques.

When the thus formed device, as better illustrated in FIG. 2, is disposed in a vacuum, and a DC potential is applied, biasing the cathode 6 negative with respect to the anode 4, an electric field is generated as suggested at $e^-$. When that field becomes greater than $10^7$V/cm, electrons are emitted from the cathode and collected by the anode. When the electrons reach the anode 4, an electric current flows, and when the device is used as a switch, is can be considered to be turned on. It is possible to control the electric field between cathode and anode by applying a voltage to the grid 3, thereby to control the switching operation. Because the electrons travel in a vacuum in such a device, their speed is greater as compared to the case where electrons travel in a semiconductor material. Such a device thus has the capability of even higher speed operation than solid state devices, and can provide a transistor which functions as a high speed switching element at ultra high frequencies.

The microminiature vacuum tube 10 illustrated in FIG. 2 by the production method described in connection with FIGS. 3*a*–3*c* relies on underetching the portion of the silicon substrate immediately underlying the photoresist in order to achieve the conical shape desired for the emitter. In wet etching, which is the process preferred for such underetching, when the degree of adhesion between the etching mask and the substrate is insufficient, it becomes difficult to control the sharpness of the conical tip with adequate reproducibility. Furthermore, because the etching rate is highly variable, and depends on the composition of the etching bath, the temperature of the liquid, the surface condition of the material to be etched, and other environmental conditions such as the degree of illumination of the device during etching, wet etching is not completely suitable for controlling tip sharpness of the conical emitter with adequate reproducibility. When the tip sharpness varies, the distribution of the electric field surrounding the tip varies, and this causes nonuniformity, from emitter to emitter, of the operating voltage needed to cause cold cathode emission. This should not be an overwhelming problem in the case where microminiature vacuum tubes are being manufactured in a laboratory for test, or in a small pilot operation, but when it is desired to produce such vacuum tube having high performance and repeatable and reliable characteristics in large commercial quantities, the problems will be substantially magnified.

FIG. 5 shows a further prior art structure which produces a finished product not substantially unlike the FIG. 2 embodiment in structure, but which is produced by a substantially different fabrication process. The fabrication technique is illustrated in FIGS. *6a–6d*. There is shown a semiconductor substrate 1, preferably monocrystalline silicon, which is covered by an etchant mask which is then patterned as illustrated at 7 to expose a central conical aperture. It is noted that the aperture need not be completely conical, but that an elongate V-shaped structure is also appropriate in providing an emitter having a sharp discontinuity for enhancing electron emission. However, the conical form will be focused on herein. Having masked the device as illustrated in FIG. *6a*, the conical aperture 8 is formed by wet etching, following which the mask 7 is removed. The device is then plated to cover the upper surface of the substrate and the walls of the conical aperture 8 with a metallic layer 6 which is intended to serve as the device cathode or emitter. The metal layer is typically thicker than a conventional conductive electrode, and is often formed of materials such as tungsten. Having covered the surface of the substrate 1 and the walls of the conical aperture 8 with a metallic layer 6 (as by sputtering or vacuum evaporation), operation switches to the rear surface of the substrate 1 to remove substrate material and expose the conical tip which is created by the metallic layer in the conical aperture. Thus, beginning with the partly completed device as illustrated in FIG. *6b*, the substrate is thinned by etching from the rear surface until the tip *6a* of the metal layer is exposed, as shown in FIG. *6c*. Having thus exposed the conical tip, a silicon dioxide layer 2 is applied to the rear surface of the substrate, and gate electrode 3 and collector electrode 4 are deposited on the silicon dioxide layer as described in connection with the previous embodiment.

As shown in FIG. 5, device operation is like that of FIG. 2 in that when a biasing potential is applied between emitter 6 and collector 4, an electric field which concentrates at the tip *6a* of the emitter is created as illustrated by the dashed lines $e^-$ to cause electron emission from the cathode and electron flow from cathode to anode. Although the conical emitter *6a* is metallic as opposed to the thin film coated semiconductor of FIG. 2, the operation under the influence of an electrical field is similar.

The fabrication method illustrated in FIGS. *6a–6d* also has substantial limitations with respect to uniformity, reliability and repeatability, although those issues are somewhat different than those associated with the FIG. 2 device and process. In the FIG. 6 process for fabricating the FIG. 5 device, since the metal structure which is to form the cathode (or emitter) is shaped inside a conical or V-shaped aperture which had previously been formed by wet etching, the tip sharpness of the electrode can be controlled with good reproducibility. While the depth of the recess 8 may vary with etching conditions, the tip sharpness does not substantially vary. It is therefore possible to obtain a relatively uniform electric field distribution surrounding the tip of the cathode, if the cathode is properly exposed by removal of the substrate material.

The removal of the substrate material, however, is not without its difficulties. As indicated in FIG. *7a*, a rather substantial volume of substrate material must be removed in order to expose the conical tip *6a*. The distance d2 identifies the bulk of the substrate which must be removed in order to expose the tip, and most typically the dimension d2 is in the range between about 100 and 500 microns. It is known that when rather massive substrate thinning is to be accomplished by etching, and the etching must proceed more than about 10 microns, what might have started as a planar surface prior to etching becomes relatively nonuniform by the time etching is completed. As a result, when a very substantial amount of material on the order of more than 100 microns is to be removed as suggested in FIG. *7a*, and considering that only the tips *6a* of the emitters are to be exposed, and the typical accuracy required must be of a micron or less, it will be appreciated that not all of the tips will be exposed to the same degree. FIG. *7b* illustrates this condition in which a first tip 6A is substantially exposed as is the tip in FIG. *7a*, whereas additional tips such as 6B remain buried in the substrate due to the uneven as-etched surface *1a*. As a result, when a plurality of elements are produced at the same time, such as would be needed in an array of vacuum tube devices, the exposed portions and unexposed portions of the respective metal tips can coexist as demonstrated in FIG. *7b*. The overall semiconductor part which results from a process as illustrated in FIG. *7b* is not expected to be suitable for its intended purpose, and the yield of acceptable devices can be expected to be relatively low.

SUMMARY OF THE INVENTION

In view of the foregoing, it is a general aim of the present invention to provide a process for fabricating a microminiature electron emitting vacuum-type device having a tip-shaped emitter which accurately and with good reproducibility produces sharply pointed conical (or V-shaped) emitter tips which stand free of the surrounding substrate material.

In that regard, it is an object to provide a process for fabricating an electron-emitting device utilizing a tipped cathode in which the cathode is first formed by depositing a thin film metallic material in the substrate, and in which the rear surface of the substrate is then removed, by optimizing the techniques for removal of the surface to achieve reliable exposure of all the tips with minimum damage to any.

In that regard, an object of the present invention is to provide an electron emitter device in which the initial steps of removing substrate material are intended to remove the bulk of material in a manner which maintains planarity of the rear substrate surface, and subsequent steps are employed for removing the final portions of the substrate which are adapted to minimize damage to the conical emitters while maximizing the chances of exposing all of those emitters.

In accordance with the invention, there is provided a process for fabricating a microminiature electron emitting device having a tipped electron emitter supported on a substrate. The process provides a substrate having opposed substantially planar front and rear surfaces. A comparatively thick metallic layer of electron emitter material is disposed on the first surface of the substrate and in a tipped aperture formed on that first surface in such a way that the metallic layer lines the wall of the aperture to form a tipped metallic structure within the substrate. The metallic layer is of sufficient thickness to render the tip self-supporting when freed of the surrounding substrate material. The rear planar surface of the substrate is then ground to remove half or more of the substrate material and to create an as-ground position of the rear surface of the substrate which is displaced from the front surface by a distance adequate to maintain the tips of the metallic structure within the substrate and protect them from the grinding step. The rear surface is then finished to create an as-finished position for the plane of the rear surface which is displaced from the front surface by a distance adequate to expose the tips.

In a preferred embodiment of the invention, the finishing step comprises mechanochemical etching to remove the bulk of the remaining substrate material, followed by wet etching which exposes the tips. In other embodiments, mechanochemical etching or chemical etching steps can be used separately.

It is a feature of the invention that the process for removing the bulk of the substrate material after forming the tips is adapted to maintain the planarity of the rear surface so that the finishing step will provide a substantially planar finished rear surface of the substrate. It is not the rear surface of the substrate being planar which is of importance, however, but the fact that the planarity of the rear surface reliably exposes all of the conical tips, without leaving some buried and others overexposed as in the prior art.

It is a further feature of the invention that the steps which expose the metal tips are adapted to accomplish that function without substantial damage to the tips, so that the tips retain their sharpness for concentrating the electrical field and emitting electrons at relatively low potential energies.

Other objects and advantages will become apparent from the following detailed description when taken in conjunction with the drawings, in which:

BRIEF DESCRIPTION OF THE DRAWINGS

FIG. 2 is a view illustrating an electron emitting device of the prior art;

FIGS. 3*a*–3*c* illustrate the process for fabricating the device of FIG. 2;

FIG. 5 illustrates the elements of an electron emitting device of the prior art;

FIGS. 6*a*–6*d* illustrate the steps of the process for fabricating the device of FIG. 5.

While the invention will be described in connection with certain preferred embodiments, there is no intent to limit it to those embodiments. On the contrary, the intent is to cover all alternatives, modifications and equivalents included within the spirit and scope of the invention as defined by the appended claims.

DETAILED DESCRIPTION OF THE PREFERRED EMBODIMENTS

Figure 1:
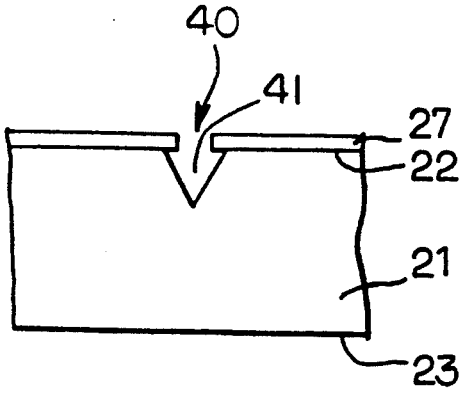
FIGS. 1*a*–1*e* are a sequence of elevational views illustrating the fabrication of a microminiature electron emitting device in accordance with the present inventions; FIG. le of that sequence illustrates the finished device.
Figure 1:
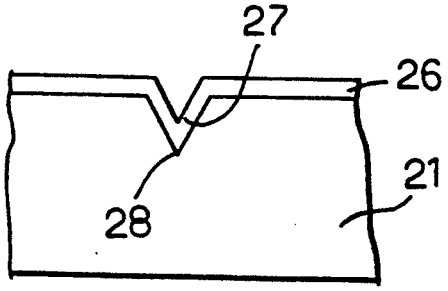
Figure 1:
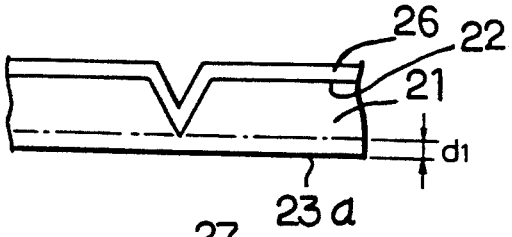
Figure 1:
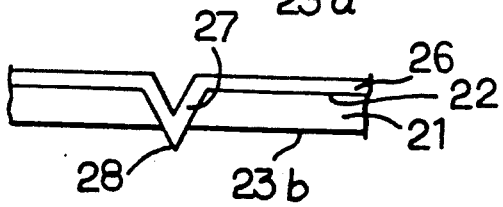
Figure 1:
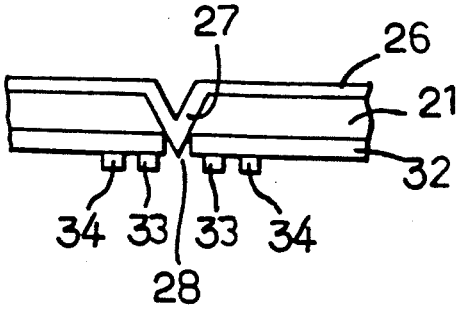

Turning now to the drawings, FIGS. 1*a*–1*e* illustrate the steps of a process for fabricating a microminiature electron emitting device in accordance with the present invention, and FIG. 1*e* illustrates the finished device.

Referring first to FIG. 1*e*, it is seen that a substrate 21 has a metallic layer 26 deposited thereon, the metallic layer 26 having a tip-shaped portion 27 with a sharply pointed tip 28 penetrating through the substrate 21. An insulating layer 32 is disposed on the bottom surface of the substrate 21 and provides a surface for support of gate electrodes 33 and collector electrodes 34. When the emitter and collector are disposed in a vacuum (not shown), carrier flow is through the vacuum, and very high speed operation is obtained.

Like the devices discussed in connection with FIGS. 2 and 5, when a potential is applied from collector 34 to emitter 27, an electrical field is established between the emitter and collector, and the field concentration is enhanced by the sharp tip 28 of the emitter 27. When the bias applied to gate 33 is suitable, electrons are emitted and flow from emitter to collector under the control of the gate. When the devices are produced in a large array, emitters and collectors of respective devices can be connected in series or parallel as desired to achieve desired current or voltage characteristics, and the gates can be connected as required by the circuit to produce an array of vacuum type devices for operation either in an analog fashion or as a very high speed switching device.

The process for manufacturing the device of FIG. 1*e* is commenced as illustrated in FIG. 1*a* by formation of a mask 27 on the upper surface 22 of the substrate 21. The substrate 21 can be silicon, GaAs, or other such semiconductor material. In the initial example, it will be assumed that the substrate 21 is GaAs.

The GaAs substrate 21 is preferably of n-type conductivity, and is oriented such that the etching of tipped recesses or apertures results in sharp and uniform tip shapes. Thus, the n-type GaAs substrate 21 is oriented with the (100) crystal plane as the upper surface 22. The mask 27 is formed by conventional photolithographic processes to form a central aperture 40 which will serve to produce the tipped apertures 41. It is noted herein that the apertures 41 are described as tipped, which is used in a generic sense. More particularly, the purpose of forming apertures with tips is to provide a sharp discontinuity in the metallic structure to be formed in the aperture, so as to cause that metallic structure to serve, when freed of the substrate material, as an effective electron emitter. Thus, one preferred form of tip-shaped aperture is conical, intended to form a conical metallic structure which, when freed at its tip from the substrate, forms a sharply pointed tip free of the substrate and adapted to emit electrons. In its most preferred configuration, the conical tipped structure is used in an array of interconnected electron emitting devices, with a plurality of such tipped conical recesses being formed in the substrate 21 for plating of a plurality of tipped metallic structures therein, and subsequently freeing of such structures, each for emitting electrons.

However, the tipped shaped nomenclature is also intended to apply to other sharply tipped structures, such as an elongate V-shaped recess which is adapted to be plated to provide an elongate V-shaped electrode having a sharp linear discontinuity adapted to emit electrons along its length. Other such useful shapes will now also be apparent to those skilled in this art, and are intended to be encompassed by the "tipped" nomenclature used herein.

Having formed the aperture 40 in the mask 27 disposed on the (100) surface of the n-type GaAs substrate 21 as illustrated in FIG. 1*a*, the substrate is then etched to produce the tip-shaped recess 41. A preferred etching solution is a tartaric acid etching solution comprising about 40 parts tartaric acid, about one part hydrogen peroxide and about 90 parts water. Using that solution with the aforementioned substrate and orientation, a groove of conic shape is formed by the etching which proceeds without crystal surface dependence. An alternate etching solution is a sulphuric acid solution comprising about 4 parts sulphuric acid, about 1 part hydrogen peroxide, and about 1 part water. Other etching solutions useful with this type of substrate are known in the art and include bromine based etching solutions and fluorine-based etching solutions.

Having formed the tip-shaped or conical aperture 41 as illustrated in FIG. 1*a*, the etching mask 27 is removed and a metallic layer 26 deposited over the upper surface 22 of the substrate in such a way that the material covers the surface of the tip-shaped aperture 41. The metal surface is shown in place in FIG. 1*b* and is seen to produce a metallic structure 27 in the tipped aperture 41, the metallic structure 27 including a sharply pointed tip 28. As noted above, when the aperture 41 is conical, the tip 28 will be a single point at the tip of the cone. When the aperture 40 is a linear V-shaped aperture, the tip 28 will be a line defining the tip of the elongate V.

The metal layer 26 comprises a metal which will serve as an electron emitter. It is preferable to utilize a metal having a work function which is less than 10.0 eV. Tungsten is a preferred example of such a material which is useful as a cathode of electron emitter. Tungsten, having a work function which is less than 10.0 eV, makes it possible to stabilize the electron emission, and render more uniform the electron emission characteristics of the device. Another useful metal which has a useful work function is platinum In either case, the metallic layer 26 is formed by known techniques such as a vacuum deposition or sputtering, in a manner which assures that the metal layer covers the walls of the recess 41 to form a metallic structure therein.

Having formed the tipped metallic structure, operation on the partly completed device of FIG. 1*b* proceeds to the rear surface 23. The rear surface 23 which, as noted above, can be on the order of 100 to 500 microns from the front surface 22, is then systematically removed to expose the tips 28 of the V-shaped structure 27.

In accordance with the invention, the bulk of the material of the substrate is removed by a process, preferably grinding, which is intended to maintain the planarity and parallelism of the surface 23 with respect to the surface 22. Thus, as illustrated in FIG. 1*c*, the first stage of material removal creates an as-ground planar surface 23*a* of the substrate which is only slightly displaced from the tips 28 of the metallic structure, but remains substantially planar and parallel to the front surface 22. The distance d1 indicates the relatively thin layer of substrate material which remains after grinding, and which must be removed in a finishing step in order to expose the tips. The preferred dimension d1 varies with the process steps used for final removal, but in all cases will be about 50 microns or less. Indeed, when the final stage of material removal is intended to utilize simple etching, in order to maintain planarity of the rear surface, the dimension d1 should be 10 microns or less. It was noted above that when etching is utilized for bulk material removal, surface planarity can become a problem after removal of about 10 microns of material.

Figure 7:
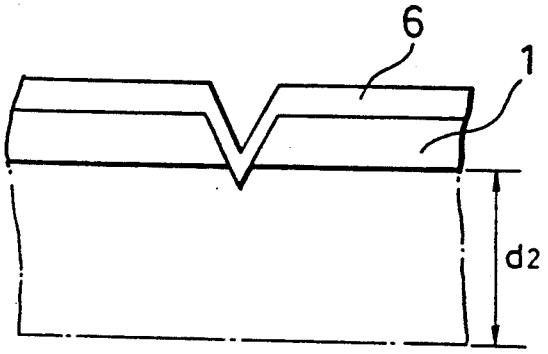
FIG .7.(a) (PRIOR ART)
FIGS. 7*a*–7*b* illustrate certain problems associated with the manufacturing process of FIGS. 6*a*–6*d*.
Figure 7:
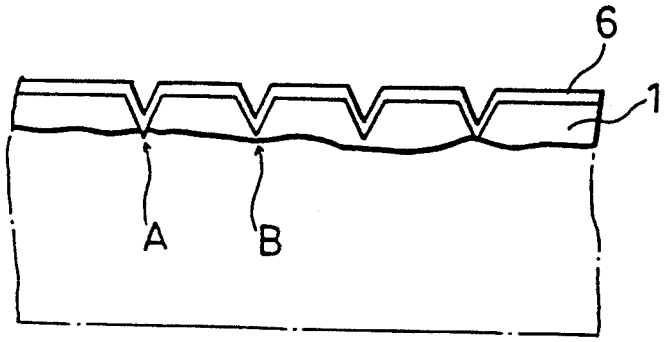
FIG .7.(b) (PRIOR ART)

In practicing the invention, the process used for proceeding from the FIG. 1*b* configuration to the FIG. 1*c* configuration comprises grinding, which has the disadvantage of being disruptive to the surface finish of the substrate, but the advantage of maintaining at least bulk surface planarity and parallelism, avoiding the unevenness associated with the prior art as illustrated in FIG. 7*b*. Grinding is understood to be an abrading process using grit particles, often embedded in a grinding surface, which scores the rear surface of the substrate and mechanically removes material. Scratches which are formed in the surface result from the grit particles being rubbed across the surface. The advantage of grinding is the fact that substantial amounts of substrate material can be removed rather quickly. An important advantage with respect to the invention, is that the plane 23*a* of the as-ground surface can be maintained substantially parallel to the plane of the front surface 22, so that the dimension d1 defining the distance between the as-yet unexposed tips and the as-ground surface 23*a* is substantially uniform from tip to tip in an array of the devices.

In further practice of the invention, a second stage material removal process is utilized to proceed from the FIG. 1*c* configuration in which the bulk of the substrate removal has been accomplished to the FIG. 1*d* condition in which the tips 28 of the metallic structure 27 are exposed. The second material removal process will be referred to as "finishing" to distinguish it from the first material removal process which has been characterized as "grinding". The finishing process can be accomplished in a number of fashions, and the preferred form comprises mechanochemical etching followed by wet etching. As will be discussed in greater detail below, in certain applications, either of those processes can be utilized on its own. The intent of the finishing process is to remove additional substrate material including the small layer d1 left by the grinding process and a small additional quantity of material to expose the tips 28 of the metallic structure 27, leaving them free of the substrate 21 so that they can serve as efficient electron emitters. Furthermore, the process steps accomplish such removal so that if an array of metallic structures 27 is being produced closely spaced on a substrate 21, all of the tips 28 will be exposed. The illustration of FIGS. 1*a*–1*e* is intended to encompass a multiple emitter array, with the focus being on simply one of the emitters in the larger array.

As noted above, the preferred finishing step comprises mechanochemical etching followed by chemical etching. As is well known, mechanochemical etching comprises a conventional wet etching process in which mechanical rubbing supplements the etching. The mechanical rubbing which supplements the etching is intended to enhance the speed of the etching and furthermore to enhance the planarity of the etching such that etching is encouraged at any high points in the structure to maintain planarity of the rear surface 23 as it progresses from the as-ground position 23*a* shown in FIG. 1*c* to the as-finished 23*b* position shown in FIG. 1*d*.

As is well known, mechanochemical etching is similar to many polishing operations in finishing of wafers. However, in the present invention, that process is applied in the partly completed semiconductor device, rather than on the wafer before semiconductor fabrication is commenced. Using the mechanochemical etching process in the present invention, the rear surface 23*a* of the substrate is mechanically rubbed in the presence of an etching solution which slowly removes the rear surface of the substrate while maintaining its planarity and parallelism to the front surface. The etching solution is preferably the same etchant used to form the groove 40 on the front surface. The rubbing is applied by a supported textured surface, such as a fabric, but in the absence of any grit. An advantage of mechanochemical etching when used following an initial grinding operation is that scratches formed by the grit particles during grinding are removed during the initial phase of the finishing operation to provide a smoother rear surface 23*a*, well adapted for the final finishing operation.

As noted above, the grinding operation is intended to leave a small quantity of material d1 protecting the metallic structure which is on the order of 50 microns or less. When a two-stage finishing operation including mechanochemical etching is utilized, the mechanochemical etching should leave just a small quantity of material covering the tips 28, so that 10 microns or less of material need be removed in the final phase of the finishing operation. In the preferred practice of the invention, the second stage of the finishing operation comprises chemical etching, which can be a continuation of the mechanochemical etching process, using the same etchant, but eliminating the mechanical rubbing operation. In the final phase, the remainder of the substrate to be removed is indeed removed, leaving the as-finished surface 23*b*, substantially planar to the front surface 22, and displaced from the front surface 22 such that the tip 28 of the illustrated metallic structure 27 is exposed, as are all of the remaining tips of similar structures in the substrate. The final phase of chemical etching without rubbing is preferred because that phase exposes the tips 28, the elimination of rubbing during this final phase protects the fabric, but more importantly protects the tips 28 so the sharply pointed configuration remains for the finished electrical device.

Having thus completed the two-phase material removal operation indicated by FIGS. 1*b* through 1*d*, the process is completed by forming an insulating layer on the as-finished rear surface 23*b* of the substrate and forming an electrode structure on the insulating layer. For example, a layer of silicon dioxide or the like is formed on the as-finished surface 23*d* by plasma CVD. A photoresist is then plated on the silicon dioxide layer to flatten the surface, and the portion at the tip 27 of the photoresist is opened using etchback by plasma etching, and the central portion of the silicon dioxide film is selectively removed by reactive ion etching (RIE). Subsequently, a conductive metal such as aluminum, gold, nickel, molybdenum, tungsten or platinum is formed over the entire surface of the insulator 32, such as by vacuum deposition or sputtering, and a photoresist is formed on the metallic layer in the desired pattern to produce the gate and collector electrode structure 33, 34. The unneeded metal is etched away by reactive ion etching or reactive ion beam etching (RIBE), using the patterned photoresist as a mask, and subsequently the photoresist is removed. Alternatively, the electrode structure 33, 34 can be formed by photolithography, plating and liftoff techniques. In either event, the resulting metallic pattern includes a grid electrode structure 33 and a collector electrode structure 34 with the necessary connecting pads. The electrode structure is formed on an insulating layer 32 which leaves the tip 28 free for emitting electrons to be collected by the collector 34 under the control of the grid 33.

While the grinding followed by two-phase finishing (mechanochemical etching and wet etching) represents the preferred practice of the invention, in some instances, the process can be somewhat simplified, particularly as it relates to the finishing operation. Thus, in some cases, particularly when the substrate 21 is of GaAs, the chemical etching step can be eliminated, and the process can proceed from the FIG. 1*c* to the FIG. 1*d* configuration using only mechanochemical etching. When the substrate is of GaAs or related compound materials, the mechanochemical etching process can be relied on for finishing, without substantial danger of damaging the tips 28 of the structure as the tips are exposed. A third process is also possible in accordance with the invention, and that comprises grinding followed by chemical etching without the need for mechanochemical etching. The third process is least favored insofar as the scratches introduced in the grinding operation may not be completely eliminated during the finishing operation. However, in certain cases, the process comprising grinding followed by chemical etching may be preferred due to its simplicity and cost effectiveness. In that instance, however, it will be desirable to grind the substrate in the first phase of the process to remove sufficient material requiring very little material removal during the finishing operation. Thus, if the grinding operation can proceed to the point of requiring only 10 or so microns of material removal to expose the tips, the tips can be reliably exposed by chemical etching. Alternatively, if single emitter devices are being produced, or devices with only a few widely spaced emitters on a substrate, chemical etching might be relied on to remove more than about 10 microns of material without surface irregularities introducing significant complications. Certain substrate materials may also be more tolerant to greater removal of substrate material by reliance solely on chemical etching.

With respect to the operation of the completed device, it is not substantially different than the devices of FIG. 2 or FIG. 5. However, the yield of the process which forms the device, particularly a multi-emitter array such as suggested in FIG. 7*a*, is expected to be substantially higher because the surface planarity of the rear surface is better maintained. Thus, the process advantages of forming the device of the invention as compared to vacuum-type devices of the prior art will be apparent. The advantages over a semiconductor device will also be apparent when it is appreciated that the travel velocity of electrons in semiconductor material is limited to about $10^7$ cm/s because of scattering due to optical phenomena and acoustic phenomena, whereas in the case of electrons traveling in a vacuum, the travel velocity can be on the order of $10^8$ to $10^{10}$ cm/s. A speed advantage represented by a factor of 10 or more is thus possible over the semiconductor device. The increase in switching speed will therefore be apparent.

Figure 4:
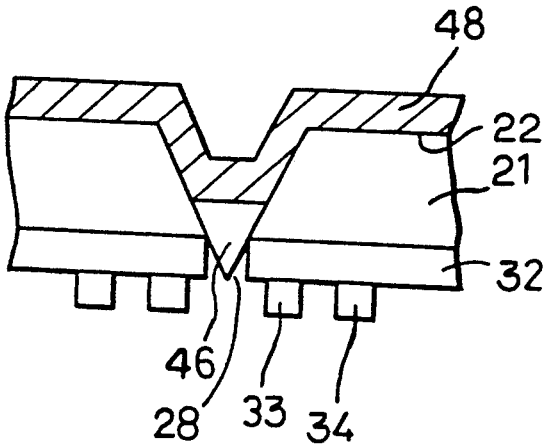
FIG. 4 is a cross-sectional view showing an electron-emitting device exemplifying a second embodiment of the present invention.

FIG. 4 illustrates an alternative embodiment of the invention which is similar to the device of FIG. 1*e*, except that the metallic structure which forms the tip 28 is modified. In the device of FIG. 4, a cathode structure 46, preferably of tungsten or platinum, is first formed and exposed, and in a subsequent step a cathode leadout electrode 48 is deposited on the front surface 22 of the substrate. Thus, the process for forming the device of FIG. 4 is altered in that the initial metallic layer which forms the tipped structure is formed only in the tips of the recesses 41 to produce the structure 46. The structure 46 is preferably of tungsten, and is relatively thick, on the order of thousands of Angstroms to tens of microns. Electrolytically plated over the tip structure 46 is a comparatively thinner layer 48 on the order of about 1 micron in thickness, of conductive material such as gold. The grinding and finishing operations are performed on the tipped structure either before or after plating the conductive layer 48 in place over the upper surface of the substrate. The gate electrodes 33 and collector electrodes 34 are formed as in the previous embodiment. The upper structure 48 is a plated structure intended to make ohmic contact with the cathode structure 46 and to provide a cathode leadout on the surface 22 of the semiconductor.

In the FIG. 4 embodiment, the metallic layer 46 which forms the tipped structure is preferably tungsten or platinum. The cathode leadout structure 46 which is formed in placed by plating or sputtering, can also be tungsten or platinum, but in addition the conductive metals aluminum, nickel, gold or molybdenum can also be utilized. The composite structure of FIG. 4 provides the possibility of lower contact resistance for any bonding wires connected between the electrical contact 48 and ancillary circuitry.

In the above-described embodiments, a GaAs substrate was utilized for substrate 21. However, a silicon substrate can also be used. When the substrate is silicon, the preferred etching solution, both for formation of the aperture 41 and for the chemical etching phases of rear substrate removal, is a fluoric acid series etching solution or a KOH etching solution.

As alternatives, for the silicon dioxide insulating layer 32, it is also possible to use other insulating films such as SiN or $TaO_3$. In addition, the gate and collector electrodes 33, 34 were described as gold, nickel, aluminum, molybdenum, tungsten or platinum. It is also possible to utilize titanium, silver or copper in certain cases. Particularly in the case of the cathode electrode 26 (or 48 of FIG. 4), the use of multi-layer film is also contemplated.

It will thus be appreciated that what has been provided is an improved process for reliably forming an electron-emitting device capable of providing a higher yield than processes used heretofore. The tip-shaped emitter structure is formed in a tip-shaped recess in a semiconductor substrate, and the tip-shaped structure is then exposed by removing the bulk of the rear surface of the substrate. A two-stage process is used for substrate removal. The first comprises grinding, which includes applying grit particles, usually fixed in a tool, to remove well over half of the substrate material to produce an as-ground surface following grinding which is planar and substantially parallel to the front surface of the substrate. The grinding phase of substrate removal is intended to remove sufficient material to leave 50 or fewer microns protecting the tip of the metallic structure formed in the substrate. A finishing operation is then applied to the rear surface of the substrate to remove additional substrate material and to expose the tips of the metallic structure, while maintaining the planarity of the rear surface. Thus, the as-ground surface is advanced to an as-finished position which reliably exposes all of the tips of the tipped electron emitting structure. The finishing process preferably includes an initial mechanochemical etching phase to remove the bulk of the remaining material, followed by a final chemical etching phase which exposes the metallic tips. Simple chemical etching to remove large quantities of substrate material is avoided, and the process thus achieves greatly enhanced planarity of the rear surface and a more reliable exposure of all of the tips of the electron emitters. The resulting vacuum-type device has more uniform electrical characteristics than have been achievable using prior techniques, particularly when the process is applied on a mass production basis.

What is claimed is:

1. A process for fabricating a microminiature electron emitting vacuum device having a tipped electron emitter supported on a substrate and disposed in a vacuum for emitting electrons from the tip, the process comprising the steps of:

forming on a first planar surface of the substrate a metallic layer of electron emitter material, the layer being formed in such a way that the material covers the surface of tipped apertures formed in the substrate, grinding a second planar surface of the substrate, opposite the first planar surface, to remove sufficient substrate material, but leaving the metallic tips covered by a thickness of substrate no greater than about 10 microns, finishing the second surface of the substrate utilizing a wet etching solution to remove additional substrate material to expose the metallic tips, and wherein the step of forming comprises etching the tipped apertures in the first surface of the substrate and plating the metallic later on the etched first surface and in the apertures prior to the step of grinding.

2. The process as set forth in claim 1 wherein the step of finishing is accomplished by the etching solution without the use of abrasive grinding particles in such a way that any surface scratches resulting from the grinding step are polished and the metallic tips freed of the substrate material without substantial damage to the tips.

3. The process as set forth in claim 1 wherein the step of finishing comprises a first mechanochemical etching phase followed by a second chemical etching phase.

4. The process as set forth in claim 3 wherein the mechanochemical etching phase removes additional substrate material without exposing the tips, and the tips are exposed during the chemical etching phase.

5. A process for fabricating a microminiature electron emitting vacuum device having tipped electron emitter means supported on a substrate and disposed in a vacuum for emitting electrons from the tip means, the process comprising the steps of:

providing a substrate having opposed substantially planar front and rear surfaces, forming a comparatively thick metallic layer of electron emitter material in tipped recess means formed on the front surface of the substrate in such a way that the metallic layer lines the walls of the recess means to form a metallic structure having tip means within the substrate, the metallic layer being of sufficient thickness to render the tip means of the metallic structure self-supporting when freed of the surrounding substrate material.

grinding the rear planar surface of the substrate to remove at least half of the substrate material and to create an as-ground position of the rear surface of the substrate which is displaced from the front surface by a distance adequate to maintain the tip means of the metallic structure within the substrate and protected from the grinding step, finishing the rear surface of the substrate to create an as-finished position for the plane of the rear surface which is displaced from the front surface by a distance adequate to free the tip means of the metallic structure, thereby reliably exposing the tip means for emission of electrons, the tip means comprises an array of individual tips for respective emitters connected by a metallic structure which plates the tipped recess means and covers the front surface of the substrate, and the tip means comprises a first metallic layer having a low work function of 10.0 eV or less, and a second conductive metallic layer electroplated on the front surface of the electrode and in ohmnic contact with the low work function metal.

6. A process for fabricating a microminiature electron emitting vacuum device having a tipped electron emitter supported on a substrate and disposed in a vacuum for emitting electrons from the tip, the process comprising the steps of:

forming on a first planar surface of the substrate a metallic layer of electron emitter material, the layer being formed in such a way that the material covers the surface of tipped apertures formed in the substrate, grinding a second planar surface of the substrate, opposite the first planar surface, to remove sufficient substrate material, but leaving the metallic tips covered by a thickness of substrate no greater than about 50 microns, finishing the second surface of the substrate utilizing a wet etching solution to remove additional substrate material to expose the metallic tips, wherein the step of forming comprises etching the tipped apertures in the first surface of the substrate and plating the metallic layer on the etched first surface and in the apertures, and, wherein the step of plating comprises plating a first material in the tips of the apertures to form the metallic tips, and electroplating a second conductive metal in contact with the tip structure.

7. The process as set forth in claim 1 in which the substrate is silicon and the etching step comprises utilizing a fluorine-based etching solution or a KOH series etching solution.

8. The process as set forth in claim 1 wherein the substrate is GaAs, and the etching step comprises utilizing a fluorine-based etching solution, a sulphuric etching solution, a tartaric acid etching solution, or a bromine series etching solution.

9. The process as set forth in claim 1 in which the metallic layer forming the metallic tip has a work function of 10.0 eV or less.

10. The process as set forth in claim 9 in which the metal layer is tungsten.

11. A process for fabricating a microminiature electron emitting vacuum device having tipped electron emitter means supported on a substrate and disposed in a vacuum for emitting electrons from the tip means, the process comprising the steps of:

providing a substrate having opposed substantially planar front and rear surfaces, forming a comparatively thick metallic layer of electron emitter material in tipped recess means formed on the front surface of the substrate in such a way that the metallic layer lines the walls of the recess means to form a metallic structure having tip means within the substrate, the metallic layer being of sufficient thickness to render the tip means of the metallic structure self-supporting when freed of the surrounding substrate material, subsequent to the forming step grinding the rear planar surface of the substrate to remove at least half of the substrate material and to create an as-ground position of the rear surface of the substrate which is displaced from the front surface by a distance adequate to maintain the tip means of the metallic structure within the substrate and protected from the grinding step, and finishing the rear surface of the substrate to create an as-finished position for the plane of the rear surface which is displaced from the front surface by a distance adequate to free the tip means of the metallic structure, thereby reliably exposing the tip means for emission of electrons, and wherein the step of finishing comprises wet etching using an etching solution adapted to remove additional substrate material to free the metallic tips, the step of grinding being performed to remove sufficient material so that the wet etching does not substantially disturb the planarity of the as-finished rear surface.

12. The process as set forth in claim 11 in which the tip means comprises an array of individual tips for respective emitters connected by a metallic structure which plates the tipped recess means and covers the front surface of the substrate.

13. The process as set forth in claim 11 in which the tip means comprises a single conical tip.

14. The process as set forth in claim 11 in which the tipped recess means in an elongate V-shaped recess forming a tip means in the shape of an elongate tip at the apex of the V.

15. The process as set forth in claim 11 wherein the step of forming comprises etching a plurality of conical apertures in the front surface of the substrate, and plating the metallic layer over the front surface and on the walls of the conical apertures to form an array of conical metallic structures having tips buried in the substrate at substantially the same level, the step of grinding serving to produce an as-ground position for the plane of the rear surface which protects all of the tips, and the step of finishing serving to produce an as-finished position for the plane of the rear surface which exposes all of the tips.

16. The process as set forth in claim 15 wherein the step of finishing comprises a first phase of mechanochemical etching in which the wet etching solution removes substrate material while the rear surface is being subjected to a mechanical rubbing action, and a second phase of wet etching without mechanical rubbing.

17. The process as set forth in claim 16 in which the step of mechanochemical etching removes substrate material without exposing the tips of the conical metallic structures, and the step of wet etching advances the plane of the rear surface to the as-finished position to expose the metallic tips.

18. The process as set forth in claim 15 in which the step of finishing comprises mechanochemical etching utilizing a wet etching solution and a grit-free polishing means, the wet etching solution being applied to rear surface in conjunction with mechanical rubbing of the polishing means to enhance the etching action and smooth the as-finished surface, the polishing means being operated in such a way as to minimize damage to the metallic tips during finishing.

* * * * *